United States Patent [19]

Krieger

[11] Patent Number: 4,749,979

[45] Date of Patent: Jun. 7, 1988

[54] TRANSFORMER COMPRISING A MAGNETIC SCREEN

[75] Inventor: Hans U. Krieger, Sinn-Edingen, Fed. Rep. of Germany

[73] Assignee: U.S. Philips Corporation, New York, N.Y.

[21] Appl. No.: 86,434

[22] Filed: Aug. 17, 1987

[30] Foreign Application Priority Data

Aug. 16, 1986 [DE] Fed. Rep. of Germany ..... 3627889

[51] Int. Cl.[4] ..... H01F 15/04

[52] U.S. Cl. ..... 336/84 M; 336/212; 336/215

[58] Field of Search ..... 336/84 R, 84 M, 212, 336/214, 215, 233, 234

[56] References Cited

U.S. PATENT DOCUMENTS 4,509,032 4/1985 Post ..... 336/84 M

FOREIGN PATENT DOCUMENTS 1946885 4/1970 Fed. Rep. of Germany ..... 336/210

*Primary Examiner*—Thomas J. Kozma

*Attorney, Agent, or Firm*—David R. Treacy

[57] ABSTRACT

In a transformer (1) comprising an E-I laminated core (2) with transformer windings (7) wound around the central limb (5), at least two metal-strip loops (10, 11) are provided for magnetic screening. The magnetic strips (10,11) extend around the corners (12) of the laminated core (2) at an as constant as possible distance from one another and perpendicularly to the lamination direction of the laminated core (2) and are welded (17) to the laminated core (2) at side areas where the magnetic field strength is low.

2 Claims, 1 Drawing Sheet

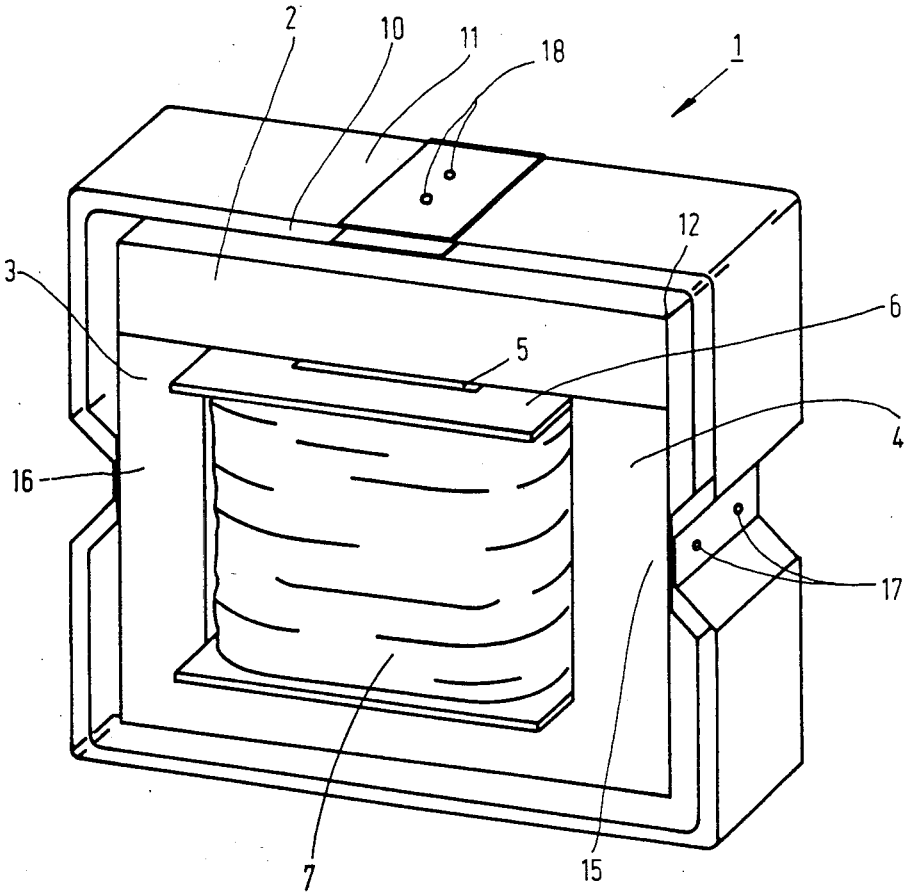
2
10
11
18
1
12
3
6
5
4
16
17
7
15

TRANSFORMER COMPRISING A MAGNETIC SCREEN

The invention relates to a transformer, comprising an E-I laminated core with transformer windings which are wound around the central limb, and at least two metal-strip loops which serve for magnetic screening and which extend around the laminated core at an as constant as possible distance from one another and perpendicularly to the lamination direction of the laminated core.

The problem of magnetic screening is always encountered in transformers intended for use in electronic apparatus, because the electronic circuits of the apparatus may not be disturbed by magnetic stray fields of the transformer. This problem is acute, for example in Compact Disc players. Notably transformers intended for use in apparatus produced in large series must have a screen which can be economically manufactured. To this end it is known, for example from DE-B-No. 31 26 498, to provide the transformer with loops formed by metal strips which serve for magnetic screening. The metal strips extend around the laminated core and perpendicularly to the lamination direction of the laminated core. However, the effectiveness of this magnetic screen is optimum only if the distance between the metal strips is as constant as possible. However, this can be achieved only in a relatively complex fashion by means of special spacers. However, in the case of manufacture of the transformer in large series it is still not ensured that a constant distance indeed exists between the metal strips.

It is an object of the invention to provide a magnetic screen of the kind set forth which simply ensures an as constant as possible distance between the metal strips.

This object is achieved in accordance with the invention in that the metal strips are welded to the laminated core at side areas where the magnetic field is weak.

Such metal strips for magnetic screening ensure an essentially more constant distance between the metal strips as well as between the metal strips and the laminated core of the transformer. The connection of the metal strips to side areas of the laminated core where the magnetic field strength is low hardly affects the magnetic screening by the metal strips, because the magnetic field is already weak at these areas so that it need hardly be damped by means of the metal strips. The metal strips are welded to one another at the areas, thus precluding elsewhere a shift of the metal strips with respect to one another and hence variations of the relative distance between the metal strips. This advantage is achieved without utilizing additional spacers or the like between the metal strips.

In a further embodiment in accordance with the invention, the metal strips are welded to the laminated core approximately halfway the length of the outer limbs of the laminated core.

In most commercially available transformers, the transformers, the magnetic field in a central area of the longitudinal dimension of the outer limbs of the laminated core is comparatively weak. Therefore, it is advantageous to weld the metal strips to the outer limbs of the laminated core at these areas. Thus, reliable positioning of the metal strips with respect to one another as well as with respect to the laminated core is ensured. Each metal strip generally consists of a suitably shaped and bent strip whose ends are welded to one another.

An embodiment in accordance with the invention will be described in detail hereinafter with reference to the drawing.

The drawing is a front view of a transformer comprising a magnetic screen in the form of two metal strips in accordance with the invention.

The transformer 1 shown in the FIGURE comprises an E-I laminated core 2. The laminated core 2 is stacked as a series of individual sheets. Two limbs (3 and 4) of the three limbs of the laminated core 2 extend in the outer zone of the laminated core, and a central limb 5 extends in the inner zone thereof. The I-shaped yoke of the E-I core extends across the limbs of the E-shaped member. The limb 5 in the inner zone is provided with a plastic coil former 6 which serves to accommodate transformer windings which are wound around the plastic coil former 6 and which thus extend around the central limb 5 of the laminated core 2. The transformer windings with a surrounding, electrically insulating envelope are denoted by the reference numeral 7 in the FIGURE.

The transformer comprising this arrangement of the laminated core, the transformer windings and the connections of the windings (not shown in the FIGURE) is ready for operation. However, such a transformer could not be used in many consumer electronics apparatus, because its magnetic field would generate hum in its own electronic circuitry or in that of neighbouring apparatus.

To this end, the transformer 1 is magnetically screened by means of two metal strips 10 and 11. The metal strips 10 and 11 extend around the corners 12 of the laminated core 2 at an approximately constant distance from one another and perpendicularly to the lamination direction of the laminated core 2. Both metal strips 10 and 11 also extend at a constant distance from the corners of the laminated core 2. The metal strips 10 and 11 contact the outer sides of the limbs 3 and 4 only at an area 5 halfway the length of the outer limb 4 and at a corresponding area 16 of the leg 3. At these areas the metal strips 10 and 11 are spot-welded (17) to one another as well as to the limbs 3 and 4 of the laminated core 2. The proximity of the two metal strips 10 and 11 at these areas does not substantially decrease their magnetic screening effectiveness, because the magnetic field of the transformer is comparatively weak at these areas.

In the embodiment shown in the FIGURE, the metal strip 10 as well as the metal strip 11 is formed in one piece from a metal band. The metal strips 10 and 11 are preshaped as desired. The ends of a metal strip are interconnected by spot welds 18. The metal strips 10 and 11 are preferably made on a highly permeable, grain-oriented electrical sheet metal.

A magnetic screening arrangement of this kind, using two metal strips arranged in the described manner, not only offers the advantage that mounting is simple, but also that the position of the metal strips is not influenced by external mechanical effects provided that the effects are not excessively strong.

What is claimed is:

1. A transformer, comprising an E-shaped laminated core with a laminated core yoke across a central and outer limbs of the E-shaped core; transformer windings wound around the central limb, and at least two magnetic metal-strip loops which provide magnetic screening and which extend around the laminated core and yoke at a substantially constant distance from one another, and perpendicularly to the lamination direction of the laminated core, the metal strips being welded to the laminated core at side areas of the outer limbs where the magnetic field is weak.

2. A transformer as claimed in claim 1, wherein the metal strips are welded to the laminated core approximately half-way the length of the outer limbs of the laminated core.

* * * * *